US005268664A

United States Patent [19]

Givler

[11] Patent Number: 5,268,664

[45] Date of Patent: Dec. 7, 1993

[54] LOW PROFILE THERMOSTAT

[75] Inventor: Omar R. Givler, North Canton, Ohio

[73] Assignee: Portage Electric Products, Inc., North Canton, Ohio

[21] Appl. No.: 8,668

[22] Filed: Jan. 25, 1993

[51] Int. Cl.[5] ..... H01H 37/04; H01H 37/52

[52] U.S. Cl. ..... 337/380; 337/112; 337/372

[58] Field of Search ..... 337/372, 380, 365, 343, 337/112, 113

[56] References Cited

U.S. PATENT DOCUMENTS 4,136,323 1/1979 D'Entremont et al. .

4,490,704 12/1984 Snider et al. ..... 337/372

4,521,760 6/1985 Carbone et al. ..... 337/372

*Primary Examiner*—Harold Broome

*Attorney, Agent, or Firm*—Darby & Darby

[57] ABSTRACT

A thermostat having a cup for housing a bimetal blade. A flange extends from the top edge of the cup which receives an insulating layer and cover material on its top surface. The cover is then folded around and under the flange, simultaneously folding the insulating layer, and then crimped. The added layers of material, which previously extended beyond the depth of the cup can now be essentially equal to the extent of the cup's depth, providing substantially no additional thickness to the overall thermostat.

8 Claims, 2 Drawing Sheets

LOW PROFILE THERMOSTAT

FIELD OF THE INVENTION

This invention relates to electrical devices. More specifically, the invention relates to casings for bimetal thermostats.

BACKGROUND OF THE INVENTION

For many thermostats, such as automatic shut-off controls to prevent circuit overheating, a bimetal blade thermostat is used. This type of device usually includes an outer case and an internal thermostat blade which is formed of a bi-layer metal, each layer having a different coefficient of thermal expansion. The blade is usually attached at one end to one portion of the case. Upon heating the thermostat above a predetermined temperature, the free end of the blade will bend toward the layer with a lower coefficient and that end of the blade will move away from a contact point, breaking the electrical connection.

Thermostats such as these have applications in microelectronic devices, where space is always a serious concern. For example, in cellular phones, these thermostats can be used to disconnect the battery if it begins to overheat. Obviously, since some cellular phones can entirely fit in a pocket, space for the internal components comes at a high premium. This type of thermostat can also be used to switch a battery charging circuit between a fast charging current and a trickle current based on the temperature of the battery. Common thermostat devices have a case with a rectangular cup. The top edge of the cup extends outwardly to form a flange. To seal the case, a layer of insulation and then a conductive cover are placed on top of the cup. The flange, along with the insulation are then folded up and over the cover and crimped, sealing the blade within the case, the insulation separating the flange from the cover. This type of thermostat is disclosed in, for example, U.S. Pat. No. 4,136,323.

However, this type of known thermostat case requires a thickness dictated by the thickness of the case, insulating and cover materials. As can be seen in prior art FIG. 1, the minimum thickness is determined by the depth of the cup plus five layers of material at the top crimp, extending above the cup, which are, in order, case A, insulation B, cover C, insulation D, and case E layers.

SUMMARY OF THE INVENTION

A thermostat is provided having a cup for housing a bimetal blade. A flange extends from the top edge of the cup. The flange receives an insulating layer and then a cover material on its top surface. Unlike the prior art, the cover is then folded around and under the flange, simultaneously folding the insulating layer, and then crimped. The added layers of material, which previously extended beyond the depth of the cup can now be generally equal to the extent of the cup's depth, providing no additional thickness to the overall thermostat.

The foregoing and other objects and advantages of this invention will become apparent to those skilled in the art upon reading the detailed description of a preferred embodiment in conjunction with a review of the appended drawings.

DETAILED DESCRIPTION OF THE PREFERRED EMBODIMENTS

Figure 2:
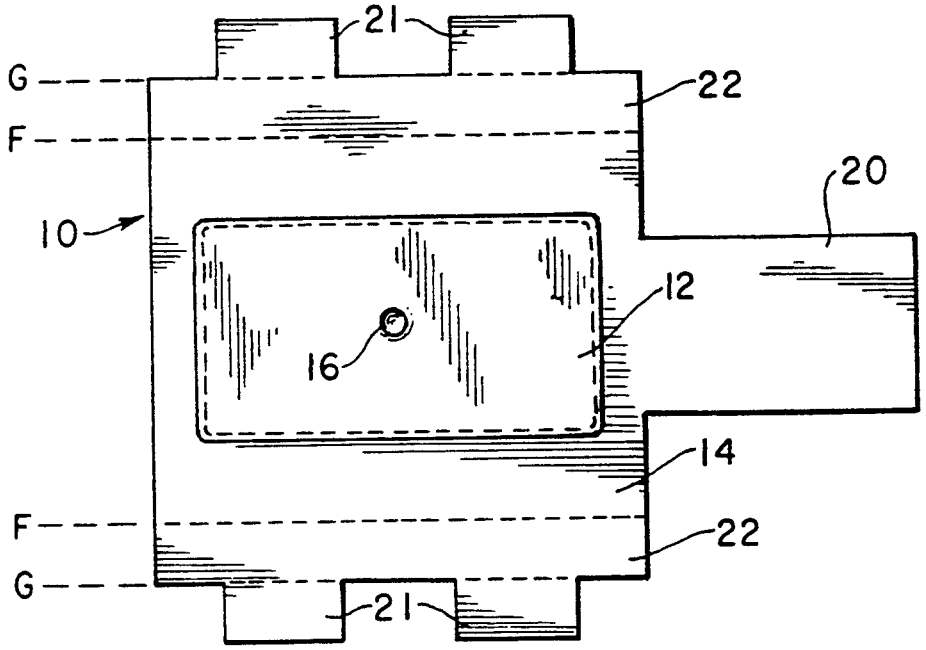
FIG. 2 is a plan view of a blank used to form a thermostat case according to the invention.
Figure 3:
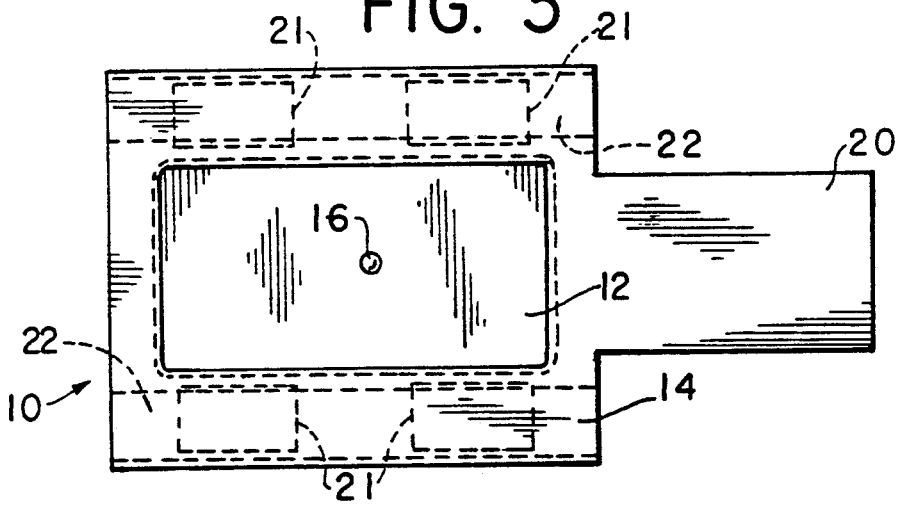
FIG. 3 is a plan view of the blank of FIG. 2 formed into a thermostat case according to the invention.
Figure 4:
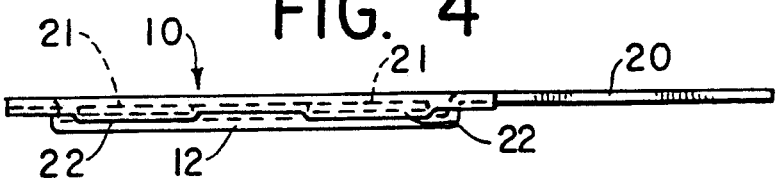
FIG. 4 is a side view of the case of FIG. 3.

Referring now to FIG. 2, a thermostat case 10 is shown, having a preferably rectangular cup 12 with a planar flange 14 extending outwardly from the top rim of the cup 12. At about the center of the cup 12, a dimple 16 is formed, which acts as a fulcrum point for a bimetal thermostat blade 18, described more fully below. Extending from the flange 14, in a direction along the length of the cup 12 is a terminal 20, which is used to provide one electrical connection of the thermostat into a circuit (not shown). Each side of the flange 14 preferably includes two tabs 21 extending outwardly from the respective side edge. The sides 22 of the flange 14 are then preferably folded under twice before assembly, at lines F and G (FIG. 2), to increase the strength of the flange 14. Once folded under (see FIG. 3), the tabs 21 cause the thickness of the folded flange to vary along the length of the case, as seen in FIG. 4.

Alternatively, only the tabs 21 may become folded initially, while the remainder of the flange 14 may become folded under during assembly, which is described in detail below. The tabs 21 and the folding of the flange 14 are not necessary for the functioning of the thermostat of the present invention. In FIG. 4, which is a side view of the case shown in FIG. 3, the depth of the cup 12 in relation to the folded tabs 21 and flange 14 is clearly shown.

Figure 5:
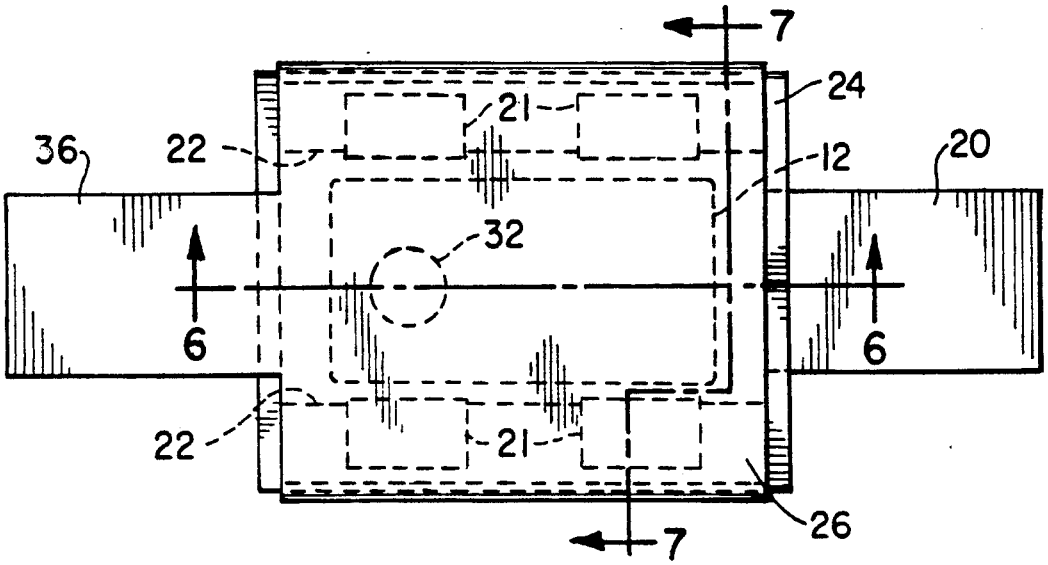
FIG. 5 is a top view of a thermostat according to the invention.

FIG. 5 shows a completed thermostat, with a portion of the case 10 covered by a layer of insulation 24 and a cover 26.

Figure 6:
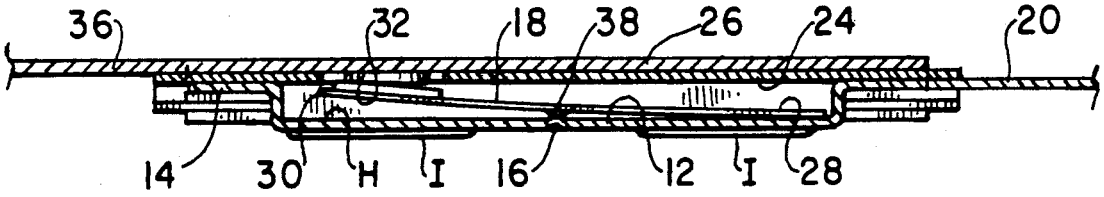
FIG. 6 is a longitudinal cross-section view, taken along the line 6—6 of FIG. 5, of a portion of a thermostat according to the invention.

FIG. 6 shows a longitudinal cross-sectional view of the thermostat shown in FIG. 5, taken along the line 6—6 of FIG. 5, which shows a thermostat blade 18 within the cup 12 of the case 10. This figure is intended to show the basic operation of the thermostat, although the operation and blade/contact structure shown in FIG. 6 are known in the art and are not considered part of the present invention.

In FIG. 6, the blade 18 is mounted to the case 10, having one end 28 of the blade 18 welded to the interior of the cup 12. The other, free end 30 of the blade 18 extends into the cup area 12 and either abuts a contact 32 welded onto the interior surface of the cover 26, as shown in FIG. 6, or oppositely abuts the interior of the cup 12 (at position H). This is determined by the composition of the bimetal blade 18 and the ambient temperature around the thermostat. In the configuration shown in FIG. 6, the blade 18 is forming an electrical connection between the cover 26 and the case 10. This translates into an electrical connection between the terminal 20 and the terminal 36 of the cover 26, which is shown in FIGS. 5 and 6. When the ambient temperature rises above a predetermined temperature, the bimetal blade 18 bends away from the contact 32, breaking the electrical connection and disconnecting the surrounding circuitry. In the preferred embodiment, the blade 18 has a raised section 38 along its length, causing it to "snap" between its two positions rather than moving gradually, or "creeping." The formed section 38 preferably abuts the dimple 16. It is also possible, however, to use a "creep" type blade that more slowly bends between connected and disconnected states. The particular type of blade chosen depends on the desired performance of the thermostat.

Figure 7:
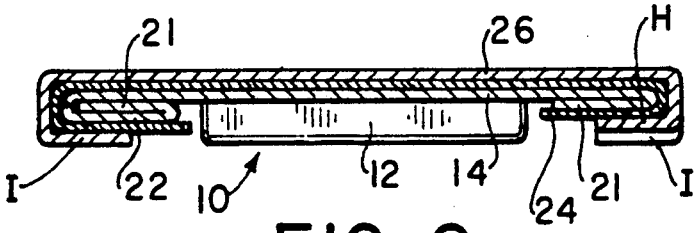
FIG. 7 is a lateral cross-section view of the thermostat, taken along the line 7—7 of FIG. 5.

FIG. 7 shows the preferred embodiment of the invention, in which the case 10 is covered by an insulating material layer 24 and then the cover 26. To form a mechanical bond between these three components 10,24,26 and to seal the cup 12, the insulating material layer 24 and the cover 26 are folded toward the cup 12 and under the flange 14 and then crimped in the configuration shown in FIG. 5. The tabs 21 and side portions 22 are preferably folded before this folding and crimping operation. It is not necessary that the flange 14 be folded, but the insulation 24 must be folded to avoid contact between the cover 26 and the underside of the flange 14. This operation becomes a more delicate task than the folding of prior art FIG. 1, as the cover material 26 requires greater force to bend than the flange 14 or insulating layer 24, and the flange 14 is more easily mangled.

As can also be seen in FIGS. 4 and 7, the thickness of the folded side portions 22 of flange 14 varies along the length of the thermostat. Thus, on the right side of FIG. 7, a portion of the flange 14 where there is no tab 21 is shown, while on the left side of FIG. 7, a tab 21 can be seen increasing the thickness of the side portion 22 of flange 14. There are at least two key results of these tabs 21. First, the cover 26 will be prevented from sliding longitudinally with respect to the case 10, which could destroy the contact between the blade 18 and the contact 32. Second, the thickness of the side portions is generally increased to slightly more than the thickness of the thermostat at the cup 12. Thus, if any pressure is put onto the thermostat by, for example, surrounding components, the folded cover 26, flange 14 and tabs 21 will absorb the pressure, rather than the cup 12. Any deformation of the cup 12 could cause the calibration of the thermostat, i.e., the position of the blade 18, to be altered. The increased thickness of the flange 14 can also be seen at positions I of FIG. 6.

Figure 1:
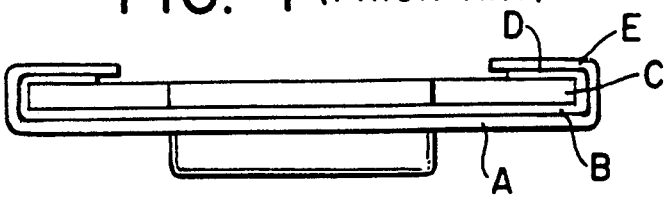
FIG. 1 (PRIOR ART)
FIG. 1 is an end cross-section view of a prior art thermostat.

The benefits in terms of overall size with respect to the prior art are significant and easily seen by comparison of FIGS. 1 and 5. The overall height of the thermostat of the present invention is decreased by the combined thickness of the insulator 24 and the flange 14. In the preferred embodiment, this decrease is over 20% of the total height. With present day electronic devices, components such as a thermostat can often be the limiting factor in terms of a circuit board's thickness, especially in view of the extremely low-profile surface mounted circuits in existence.

Figure 8:
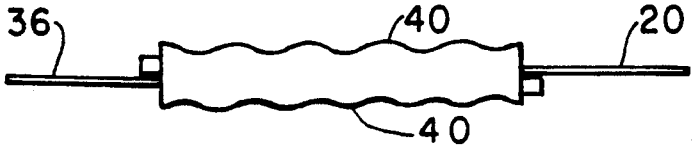
FIG. 8 is a side view of an alternate embodiment of the thermostat.

If the folded region is still found to be too thin to properly absorb pressure, or if the tabs 21 are not used at all in the construction, the folded region can be crimped with a slight wave 40, as shown by example in FIG. 8. This wave crimp increases the effective thickness to at least the thickness of the cover and cup region. With the wave crimp 40, the folded portion of the cover 26 lateral to the cup 12 has a wave height of preferably about 0.005, inches. The scale of the wave 40 in FIG. 8 is exaggerated for illustrative purposes.

It is also contemplated that if the flange sides 22 are not folded under, it is necessary that both the insulation 24 and cover 26 be wider than the flange 14 so that they can fold around and under the flange 14.

The preferred embodiment is directed to a thermostat where the case and cover are conductive. The principles of the present invention can also be applied to a non-conductive cover, except that the insulating layer is not necessary. The cover would be folded directly around and under the flange. In this situation, the non-conductive cover would have a conductor penetrating it or embedded within it to provide a contact 32 for the bimetal blade 18. Of course, the conductor in this situation would not contact the case, as this would defeat the disconnection function of the thermostat.

FIG. 5 shows the top of a completed thermostat. The cup 12 is easily seen, as well as the two terminals 20,36, one integral with the cup, the other integral with the cover, that can be connected to surrounding circuitry with any known method, such as welding or crimping.

It is contemplated that other internal thermostat devices, besides the snap-action bimetal blade 18 of the preferred embodiment, could be used similarly with the same case 10, such as, for example, a creep action bimetal blade.

Thus it is shown that with a thermostat according to the present invention, i.e. with the cover 26 and insulation layer 24 folded over the flange 14, a significant decrease in the height profile of the thermostat is attained.

While the embodiment of the invention shown and described is fully capable of achieving the results desired, it is to be understood that this embodiment has been shown and described for purposes of illustration only and not for purposes of limitation.

What is claimed is:

1. A thermostat, comprising:

a case having a cup and a flange, said cup having a bottom area and a top edge, said flange integral with and extending from said top edge;

a cover material on top of and adjacent said flange, a portion of said cover material being folded toward said bottom area of said cup and under said flange, wherein the bottom of said folded portion is substantially in the same plane as said bottom area of said cup, and thermostat means within said cup for selectively forming an electrical connection between said case and said cover material, depending on the ambient temperature.

2. A thermostat, comprising:

a case having a cup and a flange, said cup having a bottom area and a top edge, said flange integral with and extending from said top edge, said flange integral with and extending from said top edge, wherein a portion of said flange is folded under and onto itself;

a cover material on top of and adjacent said flange, a portion of said cover material being folded toward said bottom area of said cup and under said flange; and thermostat means within said cup for selectively forming an electrical connection between said case and said cover material, depending on the ambient temperature.

3. A thermostat, comprising:

a case having a cup and flange, said cup having a bottom area and a top edge, said flange integral with and extending from said top edge;

a cover material on top of and adjacent said flange, a portion of said cover material being folded toward said bottom area of said cup and under said flange;

thermostat means within said cup for selectively forming an electrical connection between said case and said cover material, depending on the ambient temperature;

further comprising an insulating material between said flange and said cover material, a corresponding portion of said insulating material being folded with said cover material; and wherein the folded portions of said cover material and said insulating material are crimped with a wave such that the effective thickness of the folded portions is substantially equal to the thickness of the thermostat at said cup.

4. A thermostat, comprising:

a case having a cup and a flange, said cup having a bottom area and a top edge, said flange integral with and extending from said top edge;

a cover material on top of and adjacent said flange, a portion of said cover material being folded toward said bottom area of said cup and under said flange;

thermostat means within said cup for selectively forming an electrical connection between said case and said cover material, depending on the ambient temperature;

further comprising an insulating material between said flange and said cover material, a corresponding portion of said insulating material being folded with said cover material; and wherein a corresponding portion of said flange is folded along with said insulating material and said cover material, such that said portion of said flange becomes folded onto itself.

5. A thermostat, comprising:

a case having a cup and a flange, said cup having a bottom area and a top edge, said flange integral with and extending from said top edge, wherein said flange has at least one tab extending from an edge thereof;

a cover material on top of and adjacent said flange, a portion of said cover material being folded toward said bottom area of said cup and under said flange; and thermostat means within said cup for selectively forming an electrical connection between said case and said cover material, depending on the ambient temperature.

6. A thermostat as in claim 5 wherein said tab is folded under said flange such that the thickness of said folded portion is increased.

7. A thermostat as in claim 6 wherein the bottom of said folded portion is below the plane of the bottom exterior surface of said cup.

8. A thermostat as in claim 5 wherein said flange has multiple tabs extending therefrom, each of said tabs being folded under said flange.

* * * * *